United States Patent [19]

Frezza

[11] 3,971,235

[45] July 27, 1976

[54] HIGH PRODUCTION STEAMER

[75] Inventor: Robert Frezza, Carle Place, N.Y.

[73] Assignee: Samcoe Holding Corporation, Woodside, N.Y.

[22] Filed: Jan. 28, 1975

[21] Appl. No.: 544,840

Related U.S. Application Data

[63] Continuation-in-part of Ser. No. 348,068, April 5, 1973, Pat. No. 3,875,624, and a continuation-in-part of Ser. No. 355,401, April 30, 1973, Pat. No. 3,868,215.

[52] U.S. Cl. ..... 68/5 E; 26/81; 34/158; 34/160; 34/242

[51] Int. Cl.[2] ..... D06B 3/20; D06B 23/18

[58] Field of Search ..... 68/5 D, 5 E, 6; 26/56, 26/68, 18.5; 34/37, 155, 158, 160, 242; 214/17 B

[56] References Cited

UNITED STATES PATENTS

| | | | |
|---|---|---|---|
| 2,255,859 | 9/1941 | Quigley | 34/155 X |
| 2,602,314 | 7/1952 | Cohn et al. | 34/160 X |
| 2,682,116 | 6/1954 | Dungler | 34/37 X |
| 2,763,912 | 9/1956 | Griffin | 68/5 D X |
| 3,040,702 | 6/1962 | Eng et al. | 34/242 X |
| 3,084,448 | 4/1963 | Dungler | 34/242 X |
| 3,257,735 | 6/1966 | Catallo | 26/56 X |
| 3,394,940 | 7/1968 | Lane | 68/5 E X |
| 3,484,949 | 12/1969 | Aronoff | 34/155 |

FOREIGN PATENTS OR APPLICATIONS

| | | | |
|---|---|---|---|
| 479,771 | 12/1951 | Canada | 68/5 D |

*Primary Examiner*—Philip R. Coe
*Attorney, Agent, or Firm*—Mandeville and Schweitzer

[57] ABSTRACT

The disclosure relates to an apparatus for steam processing tubular knitted fabric, as in a spreading or calendering operation. The steamer apparatus of the invention is characterized by its ability effectively to impart steam to the fabric at much higher rates than has been possible heretofore, consistent with satisfactory quality. Since the steaming of the fabric heretofore has constituted a limiting or bottleneck stage of calendering or similar processing operations, the ability of the new steaming device to increase the effective rate of steam application can be translated directly into higher production rates in the fabric processing operation as a whole.

The new steaming apparatus includes a pair of dripless steam boxes of heretofore known construction arranged above and below the plane of the fabric in a manner well known per se. According to the invention, however, these steam boxes are closely embraced and enclosed by a steam chamber housing, which momentarily confines the billowing steam in the immediate vicinity of the fabric surface. Steam is discharged toward the fabric in high velocity jets which are effectively continuous across the width of the fabric. The jets are arranged in opposed relation, to impinge on the fabric generally at right angles thereto. The excess steam is removed by way of a down-draft exhaust system, so that steam collected above the fabric is drawn down through it.

12 Claims, 4 Drawing Figures

HIGH PRODUCTION STEAMER

RELATED APPLICATIONS

This application is a continuation-in-part of copending application Ser. No. 348,068, filed Apr. 5, 1973, now U.S. Pat. No. 3,875,624, entitled "Edge Drive Control Means for Tubular Fabric Calendering Systems". This application is also a continuation-in-part of my copending application Ser. No. 355,401, filed Apr. 30, 1973, now U.S. Pat. No. 3,868,215, entitled "Method Of Steam Processing Tubular Knit Fabric Or The Like". Reference can be made to the copending application Ser. No. 348,068 for a more detailed description of a fabric finishing line which incorporates to advantage the apparatus of the present invention.

BACKGROUND AND SUMMARY OF THE INVENTION

In the processing of tubular knitted fabric, such as in the spreading to width or finish calendering treatment of the fabric, it is conventional practice to direct the tubular fabric over an internal spreading device. This device, often referred to as a spreader or propeller, distends the fabric laterally to a predetermined uniform width, typically advancing the fabric by means of longitudinally moving belts engaging the inner edge walls of the fabric. While the fabric is held in its laterally distended condition, and while it is being advanced through the finishing equipment, it is subjected to a steaming operation, to relax the fibers and enable the fabric to readjust to its laterally distended, geometrically uniform condition. To a large extent, the fabric then tends to retain this geometrical condition as it is delivered at the discharge end of the spreading device. When the finishing operation includes calendering, the thus spread and steamed fabric is passed directly between a pair of calender rolls, and subsequently gathered as by folding or rolling.

Heretofore, in a fabric processing operation as described above, the overall rate of production has been limited by the ability effectively to impart steam into the fabric, to achieve the necessary fiber lubrication, relaxation and overall fabric stabilization. In this connection, merely increasing the rate of application of steam to the fabric, as by increasing steam pressure or the like, has not proven to be an effective way of increasing the overall fabric production. Thus, with conventional procedures, when an effort is made simply to increase the rate of steam application, the operator is faced with serious problems of water condensation on the fabric and on the machinery. When this occurs, the fabric becomes stained by water spots, resulting in a serious loss of quality, which may more than offset any increase in production rate. This problem has existed notwithstanding the utilization of so-called dripless steam discharge boxes, because the volumes of steam are such as to give rise to unwanted condensation problems after the steam has been issued from the steam boxes.

In accordance with the invention, a pair of steam boxes of known design are mounted in opposed relation on opposite sides of the plane of the fabric being conveyed by the spreader. The steam boxes have discharge slots facing the fabric, such that high velocity jets of steam are directed in opposed relation toward the plane of the passing fabric, in a generally well known manner. Significantly higher production capabilities are imparted to this otherwise conventional configuration by closely (1) embracing and confining the steam in a substantially enclosed steam chamber through which the fabric passes while engaged by the fabric spreader, and (2) causing the confined steam to be exhausted downwardly from the enclosed chamber.

The specific proportions of the enclosing steam chamber are not known to be critical. However, it is consistent with the invention that there be a relative minimum of chamber volume above and below the steamers, with most of the open chamber volume being located immediately upstream and immediately downstream of the steam boxes. Further, the dimension of the steam chamber in the direction of fabric movement is significantly less than the length of the fabric spreader, permitting the spreader to extend entirely through the otherwise enclosed steam chamber.

To accommodate the passing through the steam chamber of the fabric spreader, which may be adjusted to various widths to suit the requirements of the fabric being processed, the steamer apparatus of the invention includes sealing elements at the entry and exit openings of the steam chamber. In one embodiment of the invention, the sealing means are in the form of flexible brush-like elements arranged to conform about the spreading device and fabric without applying any significant amount of pressure thereto, to assist in the confinement of the steam in the enclosed chamber while at the same time avoiding any pressure marking of fabric.

In another embodiment of the invention, a novel form of width-adjustable sealing elements is provided. These sealing elements may be easily moved between active and retracted positions, to enlarge or narrow the entry and exit openings of the chamber as appropriate. To advantage, the width-adjustable seals do not contact the fabric.

For most effective results, the steam chamber should be provided with its own exhaust system arranged to effect removal of the excess steam at a rate somewhat corresponding to the rate of steam discharge into the chamber, while providing for a neutral or slightly positive pressure within the chamber. Pursuant to the invention, the exhaust arrangement provides for the downward flow of the exhausting steam from regions adjacent the entry and discharge openings of the chamber, enabling highly efficient utilization of the steam to be realized. This desired operation is achieved by providing an exhaust outlet in the bottom of the chamber in conjunction with a transversely extending baffle arrangement which forms, in effect, a false bottom in the lower portion of the chamber.

The steam chamber advantageously is provided along the upper edges of the entry and exit openings with condensation collecting gutters, associated with downwardly sloping upper walls. This construction and configuration avoids condensation spotting of the fabric during the start-up phases of operation, thus avoiding the need for a substantial warm-up period.

PRIOR ART OF INTEREST

For representative prior art, reference may be made to U.S. Pat. Nos. 3,484,949; 3,585,696 and 2,494,808.

For a better understanding of the above and other features and advantages of the invention, reference should be made to the following detailed description and the accompanying drawings.

DESCRIPTION OF A PREFERRED EMBODIMENT OF THE INVENTION

Figure 1:
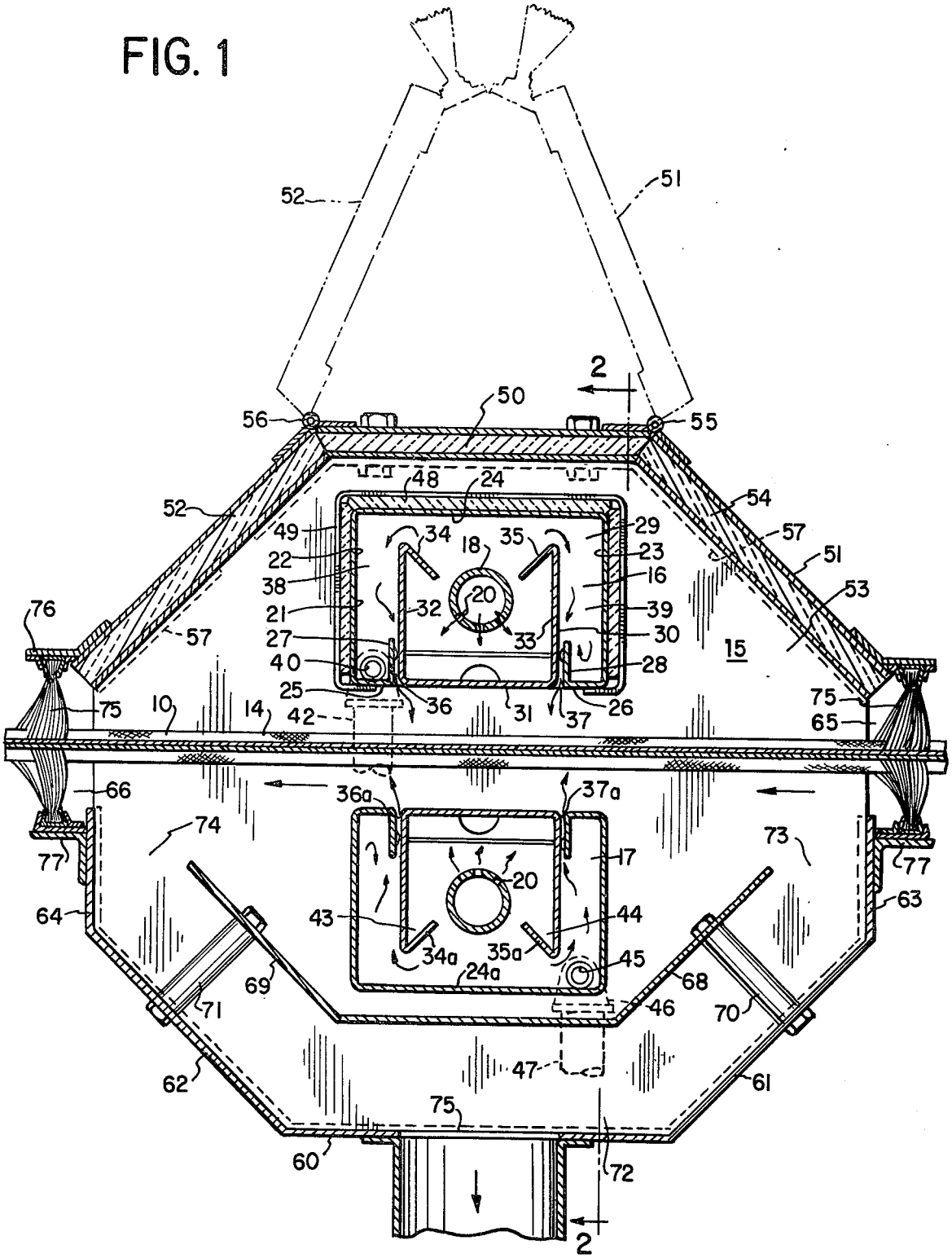
FIG. 1 is a cross sectional view of a steamer apparatus constructed in accordance with the teachings of the invention, as taken for example generally on line 1—1 of FIG. 2.

Referring now to the drawings, the reference numeral 10 designates in a general way a typical propeller spreader apparatus for tubular knitted fabrics. By way of example only, the spreader apparatus 10 may be of the type illustrated and described in the S. Cohn, et al., U.S. Pat. Nos. 2,589,344 and 2,589,345. Typically, such spreaders involve a pair of transversely spaced, longitudinally extending frame members 11 having a plurality of guide sheaves 12 supporting propeller belts 13. A tubular knitted fabric 14 is applied over the spreader frame 10, and the frame typically is so arranged or adjusted that the tubular knitted fabric is laterally distended to a flat, two-layered form, at a predetermined, uniform width. By means of external edge drive rolls (not shown) the propeller belts 13 are driven to convey the fabric by its edges substantially over the entire length of the spreader apparatus.

In accordance with the beforementioned S. Cohn U.S. Pat. Nos. 2,589,344 and 2,589,345, the spreader apparatus typically may consist of two stages, an entry stage in which the fabric is advanced at a first predetermined speed, and a processing stage in which the fabric is conveyed at a somewhat slower speed. The speed differential thus provided accommodates a lengthwise relaxation or overfeed of the fabric as it traverses the processing stage.

During the traverse of the fabric over the processing stage, it is subjected to steaming, to lubricate the fibers and the yarns and enable the necessary readjustment and repositioning thereof to occur, such that the fabric is substantially stabilized in its laterally distended condition, and has a substantially uniform width.

FIG. 1 illustrates a portion of the processing stage of the spreader, which extends entirely through a steam processing chamber 15. Within the processing chamber 15 there are mounted a pair of transversely disposed steam boxes 16, 17, which extend across the full width of the machine, immediately above and immediately below the plane of the spreader frame 10. In general, the construction of the steam boxes 16, 17 follows the teachings of the S. Cohn, et al., U.S. Pat. No. 2,602,314, granted July 8, 1952. In this respect, each steam box includes a steam pipe 18 extending transversely throughout the entire length of the steam box, typically being connected with an appropriate steam supply line 19 at both ends, or in the alternative, being connected at one end only, with a suitable cap (not shown) being provided at the other end. Within the confines of the steam box housing proper, the pipe 18 may be provided throughout with a plurality of steam distributing apertures 20. As is evident in FIG. 1, the upper and lower steam boxes 16, 17 are of generally similar construction, with certain exceptions to be noted, so that both boxes can be described with particular reference to the upper box 16, as a matter of convenience. To advantage, the steam box includes an outer housing 21 of generally rectangular cross sectional configuration and having opposed side walls 22, 23 and an upper or back wall 24. At the lower or front extremities of the side walls, there are inturned lips 25, 26 joined to upwardly directed flanges 27, 28. At each end, the steam box has an end wall 29.

Received within the above described configuration of walls in an inner chamber-forming member 30 formed of sheet metal and having a front or bottom wall 31, vertically extending side walls 32, 33, and inturned flanges 34, 35 extending toward but terminating in spaced relation to the steam pipe 18.

As will be evident in FIG. 1, the upwardly extending flanges 27 and 28, in conjunction with the vertical side walls 32, 33 of the chamber-forming member 30, define vertically elongated steam passages 36, 37, which extend transversely across substantially the entire width of the steam box.

Steam issuing from the apertures 20 in the steam pipe is directed toward the blind or closed wall 31 of the inner chamber, and then is forced to flow upward, around the pipe and out through the transversely elongated openings between the pipe and the inturned flanges 34, 35. The steam then flows outward and downward through the spaces 38, 39 between the respective pairs of side walls 22, 32 and 33, 23, toward the outlet passages 36, 37. The steam, generally under considerable pressure, is then forced out through the slots 36, 37 in restricted, high velocity streams, across the full width of the fabric 14 being processed.

The configuration of the steam box 16 is such as to provide highly effective condensate traps within the box itself, so that the issuing steam jets do not carry with them any large drops of water to saturate and stain the fabric. In this respect, the blind wall 31 of the inner chamber 30 forms a first condensate collector. In addition, further condensate is collected in the transversely extending trough formed between the flanges 27, 28 and side walls 22, 23. Any condensate collected in these areas is permitted to drain through an opening 40 in the end wall, passing out through an elbow fitting 41 and drain pipe 42.

In the case of the lower steam box 17, because of the reverse orientation thereof and the arrangement of upwardly opening steam jets **36*a* and 37*a*, condensate traps are formed at 43, 44, by the inturned flange lips 34*a*, 35*a* and by the blind back or bottom wall 24*a* of the steam box. Collected condensate is discharged through an opening 45 and flows out through an elbow fitting 46 and drain pipe 47.** Thus, in either the downward or upward orientation of the steam box, condensate developed internally of the box is substantially prevented from issuing through the steam jets.

The upper steam box 16 is shown in FIG. 1 as being insulated along its side walls 22, 23 and its upper wall 24, with slabs 48 of insulating material, secured by spaced metal straps 49. However, it is generally preferred to omit such insulation, to avoid problems of moisture absorption by the insulating material.

In accordance with the present invention, the two steam boxes 16, 17 are closely enclosed and confined by the walls of the processing chamber 15. In the illustrated arrangement, the processing chamber 15 has a more or less octagonal configuration, although this is not known to be critical. To this end, the chamber 15 is provided with an upper wall 50 which joins with front and back upper side walls 51, 52. The walls 50–52 extend the full width of the machine and are joined by end walls 53.

To advantage, the upper walls 50–52 are of insulated construction, including panels of insulating material 54 between plates of sheet metal. The upper wall 50 is rigidly connected to the end walls 53, while the front and back upper side walls 51, 52 are advantageously connected to the upper wall 50 by means of hinges 55, 56. This enables the walls 51, 52 to be pivoted upwardly, to the positions shown in broken lines in FIG. 1, to provide easy physical access to and observation of the interior of the chamber 15 when desired, outwardly bent flanges 57 formed on the end walls 53 serve to support the hinged walls 51, 52 in their operative or closed positions.

As is evident in FIG. 1, the upper side walls 51, 52 extend downward and outward from their upper edges to a level corresponding generally with the bottom of the steam box 16. These walls extend at an angle of about 45 degrees to the horizontal, defining in part confined processing areas immediately upstream and downstream of the steam box 16 and immediately above the plane of the fabric spreader 10.

The processing chamber 15 also has a bottom wall 60, spaced well below the lower steam box 17, and front and back bottom side walls 61, 62 extending upwardly and outwardly therefrom. In addition, there are provided side walls 63, 64 extending upward from the upper, outer extremities of the bottom side walls and terminating a short distance below the plane of the fabric spreader 10. The several walls 60–64 extend across the full width of the chamber 15 and are connected by the end walls 53. Together with the upper walls 50–52, the walls 60–64 form a substantially complete enclosure provided with entry and exit openings 65, 66 in the form of relatively narrow elongated transverse slots at the upstream and downstream extremities to receive the spreader frame 10 and the fabric 14 passing thereover.

Directly underneath the lower steam box 17 is a baffle plate structure comprising a lower baffle wall 67 from which walls 68, 69 extend upwardly and outwardly. The baffle 67–69 forms confined processing areas of generally triangular cross section immediately upstream and downstream of the lower steam box 17 and generally opposing the similar processing areas formed in the upper portion of the chamber. The baffle structure typically is supported from the bottom side walls 61, 62 of the chamber by means of spacer posts 70, 71, providing an open channel 72 between the baffle and the bottom structure 60–62.

In the illustrated arrangement of apparatus, the lower channel or passageway 72 is open at its upstream and downstream extremities 73, 74, which are adjacent the transversely elongated entry and exit openings 65, 66 to the chamber. In addition, there is provided a downdraft exhaust outlet 75 in the lower portion of the chamber, which is connected to a suitable exhaust blower (not shown). To greatest advantage, the exhaust blower is so constructed and/or controlled, with respect to the rate of flow of steam being ejected into the interior of the processing chamber 15, that a slight positive pressure is maintained within the chamber. In this respect, it is acceptable for some amount of the steam to escape from the chamber through the inlet and outlet openings 65, 66.

Suitable arrangements (not shown) are typically provided for removal of steam condensate from the lower portion of the processing chamber. To this end, the baffle plate structure 67–69 may accommodate the drainage therefrom into the lower portion of the chamber, as by providing suitable clearance spaces at the ends, and a suitable drainage outlet may be provided in the bottom wall 60 for the continuous or periodic removal of collected condensate.

Figure 2:
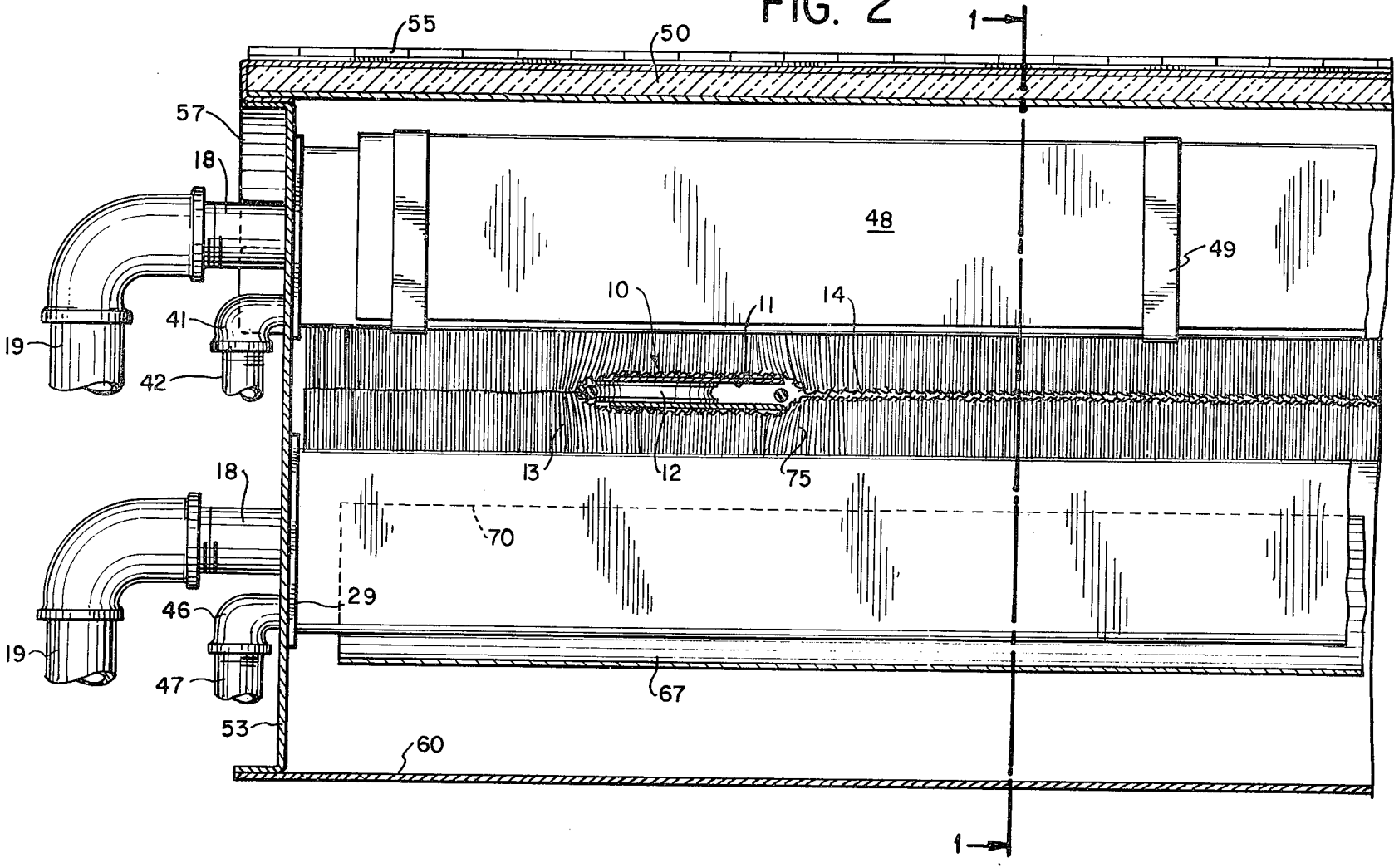
FIG. 2 is a longitudinal cross section of the steamer apparatus of FIG. 1, as taken generally on line 2—2 of FIG. 1.

In the form of the invention, illustrated in FIGS. 1 and 2, the transversely elongated entry and exit openings 65, 66 are provided with flexible sealing means adapted to lightly contact and conform to the surface of the passing fabric to inhibit the escape of steam from the processing chamber. To advantage, the flexible sealing means may comprise soft brushes 75 mounted on brackets 76, 77 secured to the walls of the chamber 15 immediately above and below the entry and exit openings 65, 66. The soft brushes 75 lightly contact the surface of the moving fabric 14 in the manner shown in FIG. 1. While by no means forming a tight seal, the sealing brushes 75 do partly impede the outflow of the steam from the processing chamber 15, which is ideally maintained at only a slight positive pressure with respect to the ambient.

In some instances, where highly effective exhaust hood means are provided in the immediate vicinity of the steam chamber 15, it may be at least marginally acceptable to permit all of the excess steam to escape through the entry and exit openings 65, 66, to be immediately collected and withdrawn by a closely adjacent forced draft exhaust hood.

As is reflected in FIG. 1, the cross sectional dimensions of the processing chamber 15 are such, in relation to the dimensions of the steam boxes 16, 17, that the excess steam, after issuing from the steam discharge openings 36, 37 and **36*a*, 37*a* and passing through the fabric, is at least temporarily confined within the processing chamber, in close proximity to the steam boxes and in contact with the surfaces of the fabric. Because of the thermal insulation provided on the upper walls 50–52** of the processing chamber, steam condensation on these walls is minimized to an acceptably low level, so that it does not adversely affect the production.

The additional temporary confinement of the excess steam in contact with the fabric immediately following its issuance from the steam boxes proper, greatly enhances the ability of the process to achieve the desired levels of steam penetration of the fabric within a short period of time. As a result, it is possible to significantly increase the speed of passage of the fabric 14 through the steam processing chamber, still achieving adequate levels of steam penetration but without experiencing spotting or staining of the fabric from condensation. In practice, this has enabled the production speed of the steaming operation to be doubled in some cases. And since the steaming operation has represented the "bottleneck" of the fabric finishing procedure, it has been thus made possible in those cases to double the production rate of the finishing procedure as a whole.

Figure 4:
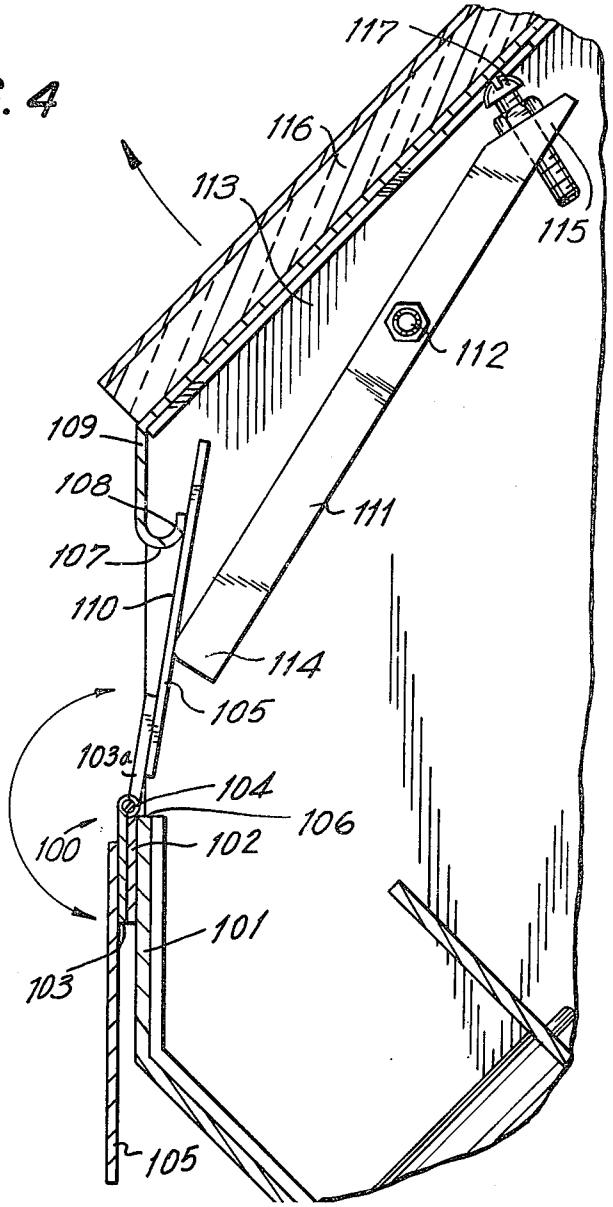
FIG. 4 is an enlarged, fragmentary cross sectional view taken generally on line 4—4 of FIG. 3.
Figure 3:
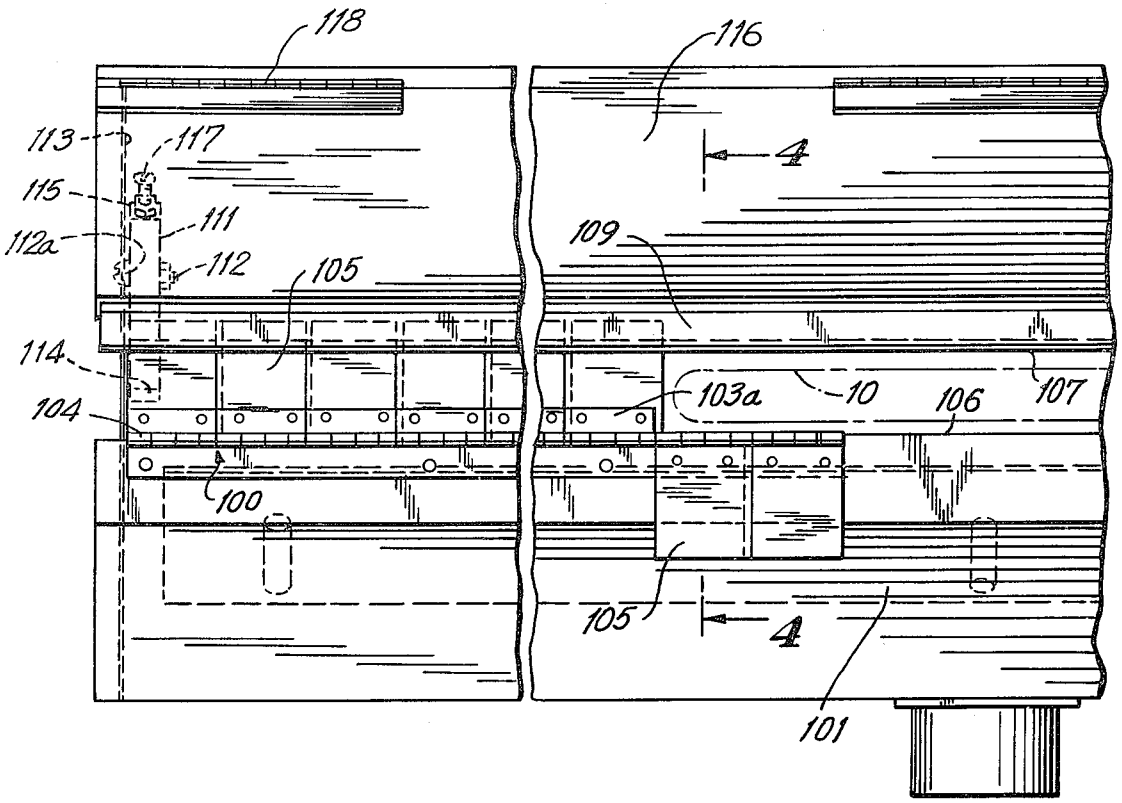
FIG. 3 is a fragmentary end elevational view of a steamer apparatus according to the invention, incorporating a modified form of width-adjustable entry and exit seal.

With reference now to FIGS. 3 and 4, there is shown a modification of the new steamer structure, which incorporates a form of adjustable sealing means. The modified sealing means, while usable to advantage under most any circumstances, are particularly desirable for use in conjunction with highly sensitive, easily marked fabrics, in that there is no contact at all with the outside face of the fabric as it passes through the steaming zone.

In the modified form of the sealing means, an elongated hinge assembly 100 is secured to the lower front wall 101 of the steam chamber. The hinge assembly 100, which comprises a first strip 102 fixed to the chamber wall, extends from the end extremity of the steam chamber inward toward the center line. Although FIGS. 3 and 4 illustrate only one half of the chamber structure, it will be understood that hinge assemblies 100 are provided at opposite ends of both the upstream and the downstream openings in the chamber, extending from opposite ends of the chamber inward toward the center thereof.

Each of the hinge assemblies includes swingable sections 103 connected by a hinge pin 104. Although the fixed hinge strips 102 may be continuous, the swingable part 103 is divided into a plurality of independently swingable segments 103*a*, each of a relatively narrow width, such as 2 or 3 inches.

Each of the independently swingable segments 103*a* has secured to it a swingable sealing plate 105, which may be formed of suitable material, such as sheet metal or plastic. The sealing plates 105 are of slightly greater width, than the hinge segments 103*a*, as will be more fully explained, and are of a height to extend from the lower lip 106 of the steam chamber opening to and beyond the upper lip 107.

In general, the arrangement of the swingable sealing plates 105 is such that, with all of the plates in an active or sealing position, the unsealed central opening of the steam chamber is of a width suitable to accommodate the minimum width of material to be processed. In order to accommodate processing of materials of greater width, individual sealing plates are swung outwardly and down, starting with the innermost plates and, progressing toward the end of the steam chamber, until the center openings into and out of the steam chamber are appropriately enlarged. In the illustration of FIG. 3, for example, two of the sealing plates 105 on each side have been swung outwardly and permitted to fall to retracted positions. Assuming that the sealing plates have a typical width of 2 inches, this would increase the center opening into the steam chamber by a total of about eight inches. Experience indicates that sealing plates of 2 inches in width provide adequate sealing for the purposes of the invention, even though there may be small clearances around the edges of the fabric.

As reflected in FIG. 4, the upper lip 107 of the steam chamber is formed by an in-turned condensation gutter 108 provided along the upper front wall 109 and extending across the full width of the steam chamber. To bring the plates 105 in operative position, they are swung upwardly to a position as shown in FIG. 4, wherein the outer surfaces 110 of the sealing plates engage or lie close to the inner surfaces of the condensation gutter 108. The height of the sealing plates is such, that the upper extremity extends somewhat beyond the gutter.

The condensation gutters 108, provided in conjunction with both the entry and exit openings of the chamber, greatly expedite the start-up of the equipment by collecting condensate accumulating on the chamber upper walls during the initial warm-up and flowing it to the side. Because of the downward slant of the upper walls, condensate forming thereon during the start-up period flows downward to the gutters 108 and is removed.

As shown in FIG. 3, each of the sealing plates 105 slightly overlaps with its neighbor in the direction of the end of the chamber, so that a laterally shingled configuration is provided. By means of this arrangement, an entire series of operative sealing plates, may be held in the desired, upraised position by holding only the endmost plate associated with each hinge assembly, and causing all of the the other plates to be supported by overlapping its outside neighbor.

In the illustrated form of the apparatus, support means for the sealing plates 105 are provided in the form of a lever 111, which is pivotally mounted on the end wall 113 of the steam chamber, by means of a bolt 112 and friction washer 112*a*. The lower end 114 of the lever is arranged to engage with the inside surface of the endmost sealing plate 105, substantially as reflected in FIG. 3. The upper end 115 of the lever is arranged for engagement with the upper side wall 116 of the steam chamber, as shown in FIG. 4. For this purpose, an adjusting bolt 117 threadedly engages the upper end of the lever, to enable the lever to be adjustably positioned in relation to the upper side wall 116.

In setting up the machine to process goods of a particular width, the upper side wall 116 typically will be lifted to an open position, being swingable about hinges 118 along its upper edge. It may be convenient, initially, to pivot all of the sealing plate 105 outward and downward to their retracted positions. After installing and adjusting the fabric spreader 10 and thus establishing the necessary width of the chamber opening, the sealing plates may be pivoted upwardly, one at a time, starting from each end of the chamber and progressing inward toward the center, until all of the plates, located outside of the edge extremities of the spreader, are in operative position.

Raising of the selected sealing plates is carried out while the upper side wall 116 is in an upraised position, so the upper extremities of the plate do not interfere with the condensation gutter 108. The outermost plate engages the lever 111, which is initially held in a desired position by means of friction in the pivot connection 112 or, if necessary, by a suitable stop lug (not shown). Thus, when the endmost plate 105 is swung upward into position, it is retained approximately in the desired position by the lever 111. As successive plates are moved into position, each is supported by its neighbor on the outside, by reason of the overlapping arrangement of the side edges. When all of the desired sealing plates have been brought into operative position, on both sides of the spreader 10, the upper side wall 116 is lowered into its operative position. Contact between the upper side wall 116 and the adjusting bolt 117 causes the lower end 114 of the lever 111 to be pressed firmly against the endmost sealing plate 105, so that it and all of the other upraised sealing plates are held in their operative positions. This same procedure is, of course, followed with respect to both sides and for both the entry and exit openings of the steam chamber.

The modified form of seal, while being simple and inexpensive to install and easy to operate, provides a highly effective seal for the purposes intended. It is especially advantageous, of course, with respect to fabrics which are easily marked and should be maintained as free as practicable of contact during steam processing.

In the embodiment of FIGS. 3 and 4 the provision of condensate collecting gutters add importantly to efficiencies in non-continuous operations. In a typical case it may be as long as a half hour, after opening of the steam valves, before a cold machine is brought up to desired operating temperatures. In the meantime, condensate may form on the chamber roof. In the absence of the collecting gutters, it would be necessary to fully pre-heat the equipment prior to running fabric, in order to avoid spotting. Using collecting gutters in the manner indicated enables cloth to be processed almost immediately.

In either of the illustrated forms of the invention, great effectiveness is achieved by utilizing a down draft, forced exhaust arrangement, while at the same time maintaining a slightly positive (relative to ambient) pressure within the chamber. This enables a maximum rate of steam application to be utilized without exposing related equipment to excessive amount of free steam.

Particularly high steam penetration efficiencies are realized by exhausting the steam chamber from the lower portion, below the processing plane. Thus, the steam, which has a natural tendency to rise, will have a maximum opportunity for passage through and contact with the fabric. The overall result is a significant increase in the rate at which steam may be applied to fabric in a steam processing operation without causing water stains and other processing defects. And, of great importance, by increasing the effective rate at which steam processing may be carried out, it becomes possible to increase the speed of an entire production line, as the steaming procedure heretofore frequently has constituted the speed-limiting stage of the process.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A high production processing steamer for imparting moisture to tubular knitted fabric or the like, comprising a. means for conveying the fabric in relatively flat form along a predetermined, generally horizontal processing plane, b. a pair of steam boxes mounted in opposed relation, one above and one below the processing plane, c. said steam boxes having effectively continuous slot-like steam discharge openings extending across the width of the fabric and arranged to direct opposed, high velocity streams of steam toward the fabric generally perpendicular to the processing plane, from above and below said plane, and d. confining means above and below the processing plane forming an enclosed processing chamber containing the said steam boxes and substantially enclosing a portion of the conveying means inclusive of that passing between the steam boxes, e. said confining means substantially entirely enclosing said steam boxes and limited portions of the conveying means upstream and downstream thereof relative to the direction of fabric movement, f. said confining means having transversely elongated slit-like openings in its upstream and downstream sides to accommodate the presence of the conveying means and providing for at least limited egress of steam from the chamber, g. said confining means being so constructed and arranged as to temporarily confine steam ejected from the steam boxes to a limited region closely surrounding the fabric, and h. forced draft steam exhaust means communicating with said confining means below said processing plane, i. said confining means being substantially closed in the regions above said processing plane, whereby confined steam above said plane is withdrawn through said fabric and removed through said exhaust means.

2. A processing steamer according to claim 2, further characterized by a. sealing means being mounted on said confining means and partially closing off said slit-like openings to at least slightly impede the egress of steam while accommodating the presence of the conveying means and the movement thereover of the fabric being processed.

3. A processing steamer according to claim 2, further characterized by a. said sealing means comprising opposed cooperating pairs of soft brushes disposed above and below said processing plane and adapted to be in light contact with the fabric during processing thereof.

4. A processing steamer according to claim 2, further characterized by a. said sealing means comprising a plurality of independently hinged sealing plates, b. said plates being of relatively narrow width in comparison to the overall width of said openings.

5. A processing steamer according to claim 4, further characterized by a. said sealing plates being arranged in a side-by-side series, with a portion of each plate at least slightly overlapping with the neighboring plate on one side, and b. means for supporting a selected plate in an operative, sealing position, with other plates being supported by reason of the overlapping relationship of the series of plates.

6. A processing steamer according to claim 1, further characterized by a. said confining means having downwardly inclined upper walls extending toward said slit-like openings, and b. in-turned condensate collector means extending transversely along the upper edge regions of said openings and serving to collect and divert condensate flowing toward said openings.

7. A processing steamer according to claim 1, further characterized by a. said exhaust means being so related to the amount of steam ejected by said steam boxes as to maintain at least slight positive pressure within the enclosure during normal processing operations.

8. A processing steamer according to claim 1, further characterized by a. said confining means comprising, in the region below the processing plane, a baffle structure, and b. said enclosure having a bottom wall structure located below said baffle structure and having therein said outlet means.

9. A high production processing steamer for tubular knitted fabric or the like, comprising a. means for conveying the fabric in relatively flat form along a predetermined, generally horizontal processing plane, b. a pair of steam boxes mounted in opposed relation, one above and one below the processing plane, and in close proximity thereto, c. said steam boxes having effectively continuous steam discharge means for directing high velocity jets of steam at a large angle toward said processing plane and into the fabric being conveyed therealong, d. confining means above and below the processing plane forming in conjunction with the steam boxes steam confinement regions of limited area directly adjacent the processing plane, above and below it, immediately upstream and downstream of the steam boxes, e. said confining means forming a processing chamber and serving to confine temporarily to said regions steam ejected from the steam boxes, f. steam exhaust means for withdrawing, from a region below the processing plane, steam from above the processing plane, g. said confining means comprising means forming a processing enclosure about the steam boxes and having limited openings therein for the accommodation of the conveying means, h. said steam exhaust means including steam outlet means in the lower portion of said enclosure, below the processing plane, and exhause means connected to said outlet means for withdrawing steam from said enclosure, i. said confining means comprising, in the region below the processing plane, a baffle structure, j. said enclosure having a bottom wall structure located below said baffle structure and having therein said outlet means, k. said baffle structure extending under the lower steam box and having portions extending upwardly and outwardly at an angle to the horizontal to form with the processing plane regions of generally triangular configuration immediately upstream and immediately downstream of the lower steam box, and l. the bottom wall structure of said enclosure being spaced below the baffle structure and forming therewith steam exhaust passages having entrance openings spaced outward from the lower steam box.

10. A processing steamer according to claim 1, further characterized by a. said confining means including means disposed above the steam boxes and forming upper side walls extending outward and downward and having their upper edges in the vicinity of the steam boxes, and b. means are provided for hingedly mounting the upper edges of said upper side walls, permitting upward pivoting movement to expose and provide access to the interior of the processing chamber.

11. A high production processing steamer for tubular knitted fabric or the like, comprising a. means for conveying the fabric in relatively flat form along a predetermined, generally horizontal processing plane, b. a pair of steam boxes mounted in opposed relation, one above and one below the processing plane, and in close proximity thereto, c. said steam boxes having effectively continuous steam discharge means for directing high velocity jets of steam at a large angle toward said processing plane and into the fabric being conveyed therealong, d. confining means above and below the processing plane forming in conjunction with the steam boxes steam confinement regions of limited area directly adjacent the processing plane, above and below it, immediately upstream and downstream of the steam boxes, e. said confining means forming a processing chamber and serving to confine temporarily to said regions steam ejected from the steam boxes, f. steam exhaust means for withdrawing, from a region below the processing plane, steam from above the processing plane, g. said confining means having narrow entrance and exit openings to accommodate the passage of fabric being processed, h. sealing means being provided to seal said openings in the regions extending laterally beyond the edges of said fabric, i. said sealing means comprising a plurality of plate-like members of relatively narrow width in relation to the overall width of the openings and being movable selectively between sealing positions and retracted positions, and j. said sealing plates being hingedly mounted along the lower edges of said openings and, when in sealing position, extending upward to the upper edges of said openings.

12. A processing steamer according to claim 11, further characterized by a. said sealing plates being arranged in laterally overlapping relation whereby at least certain of said plates are supported in operative position by adjacent plates.

* * * * *